US005581967A

United States Patent [19]

Glatz

[11] Patent Number: 5,581,967

[45] Date of Patent: Dec. 10, 1996

[54] FLOORING ADAPTER TRANSITION DEVICE

[75] Inventor: Jerald L. Glatz, Garrettsville, Ohio

[73] Assignee: Duramax, Inc., Ohio

[21] Appl. No.: 514,179

[22] Filed: Aug. 11, 1995

[51] Int. Cl.[6] ..... E04B 1/68

[52] U.S. Cl. ..... 52/465; 52/396.04; 52/468

[58] Field of Search ..... 52/169.7, 287.1, 52/288.1, 393, 396.04, 396.1, 465, 468

[56] References Cited

U.S. PATENT DOCUMENTS

| | | | |
|---|---|---|---|
| 3,514,914 | 6/1970 | Bergquist | 52/716.1 |
| 3,549,471 | 12/1970 | Denton | 52/273 X |
| 4,845,910 | 7/1989 | Hanson | 52/287.1 |
| 4,913,576 | 4/1990 | Grant | 52/396.04 X |
| 5,010,703 | 4/1991 | Pearlman | 52/288.1 |
| 5,129,138 | 7/1992 | Stensrud | 52/468 X |
| 5,184,445 | 2/1993 | Hoopengardner | 52/741.1 |
| 5,212,923 | 5/1993 | Pelosi et al. | 52/288 |
| 5,243,798 | 9/1993 | Elliott | 52/287.1 X |

OTHER PUBLICATIONS

Johnsonite® Coloright Flooring System catalog, 1993.

*Primary Examiner*—Carl D. Friedman
*Assistant Examiner*—Beth A. Aubrey
*Attorney, Agent, or Firm*—D. Peter Hochberg; Mark Kusner; Michael Jaffe

[57] ABSTRACT

A flooring adapter device for providing a transitional flooring surface between two flooring materials of different heights. The flooring adapter device includes a generally planar central portion which is sloped relative to a base portion. The sloped central portion provides a surface having a gradual rise (or descent) between the two flooring surface materials joined by the flooring adapter device.

16 Claims, 1 Drawing Sheet

FLOORING ADAPTER TRANSITION DEVICE

FIELD OF THE INVENTION

The present invention relates generally to a flooring adapter device, and more particularly to a flooring adapter device for providing a transitional flooring surface between two flooring materials of different heights.

BACKGROUND OF THE INVENTION

When two flooring materials of different heights are placed adjacent to one another, it is often necessary to provide a flooring adapter device therebetween. In this respect, a flooring adapter device acts as a "bridge" between the flooring materials. The transitional flooring surface of the flooring adapter device provides a gradual change in the height of the flooring surface between the two flooring materials.

A transitional flooring surface is particularly important where the relative heights of the flooring materials differ substantially, such as carpet and rubber or vinyl tile. In this respect, the transitional flooring surface is necessary to prevent the possibility of an individual from tripping as they walk between the two flooring materials and to provide a gradual ascent or decent for wheeled apparatus moving between the two flooring materials.

With regard to individuals walking or running between two flooring materials having different heights, there is a possibility that as the individual crosses from the lower flooring material to the higher flooring material that they may trip over the higher flooring material, and consequently injure themselves. It is also possible that as the individual crosses between the two flooring materials that they may lose their balance due to the sudden rise or fall in the height of the flooring material. This may also lead to injury.

Where a wheeled apparatus is rolled between two flooring materials having different heights, the wheeled apparatus may become jarred due to a bump created by the differing heights of the flooring materials. In this respect, the wheeled apparatus may encounter a sudden decent as it moves from the higher flooring material to the lower flooring material, or may encounter a sudden ascent as it moves from the lower flooring material to the higher flooring material. Another problem encountered when moving from a lower flooring material to a higher flooring material is that the higher flooring material may act as an impediment to movement of the wheeled apparatus between the flooring materials. In this regard, it may be necessary to apply an additional force to the wheeled apparatus or lift up the wheeled apparatus onto the higher flooring material.

With respect to pedestrians walking or running between two flooring materials of differing heights, the transitional flooring surface provided by a flooring adapter device can reduce or eliminate any obstacle created by the higher flooring material, and provide a more gradual change in heights between the two flooring materials.

In a situation where an apparatus having wheels is moved between two flooring materials of differing heights, the transitional flooring surface provided by a flooring adapter device reduces or eliminates jarring to the wheeled apparatus as it moves between the two flooring materials and eliminates any impediment caused by a higher flooring material.

In the case of a health care facility, such as a hospital, it is common today to find hallways having carpeting, and operating and treatment rooms having vinyl or rubber flooring (e.g., tile). A flooring adapter device providing a transition surface between the carpeting and vinyl or rubber flooring is necessary to prevent injury to individuals walking or running between the flooring materials of differing heights, and to prevent jarring individuals riding in wheelchairs or gurneys that are moved between the flooring materials. In the case of wheelchairs and gurneys, it should be appreciated that jarring or sharp bumps occurring as the wheelchairs or gurneys are moved across two different flooring materials may cause harm or discomfort to a patient who has just received surgery.

The transitional flooring surface provided by prior art flooring adapter devices have steep slopes. These steep slopes create a disruption in the flooring surface which does not adequately prevent injury (e.g., tripping or falling) to pedestrians walking or running, and which does not adequately prevent jarring and bumping to wheeled apparatus, such as wheelchairs and gurneys.

The present invention overcomes these and other drawbacks of prior art flooring adapter devices.

SUMMARY OF THE INVENTION

According to the present invention, there is provided a flooring adapter device providing a transitional flooring surface between two flooring materials of different heights. The adapter device is comprised of an elongated substantially flat member having a lower surface and an upper surface. The lower surface is comprised of a generally planar base portion adapted to be affixed to a floor surface, and first and second generally L-shaped shoulders formed at opposite ends of the base portion, said L-shaped shoulders respectively defining first and second flooring material receiving cavities. The upper surface is comprised of a generally planar central portion sloped relative to the base portion, and first and second side portions formed at opposite ends of the central portion and respectively connecting said upper surface to said lower surface.

It is an object of the present invention to provide a flooring adapter device providing a transitional flooring surface between two flooring materials having different heights.

It is another object of the present invention to provide a flooring adapter device providing a transitional flooring surface between carpeting and vinyl or rubber flooring.

It is still another object of the present invention to provide a flooring adapter device including a transitional flooring surface which provides a gradual change in the height of the flooring surface.

It is still another object of the present invention to provide a flooring adapter device suitable for use in health care facilities where wheeled apparatus, such as wheelchairs and gurneys, are moved between two flooring materials of different heights.

It is yet another object of the present invention to provide a flooring adapter device that provides a transitional flooring surface between flooring materials of different heights, and which does not cause a wheeled apparatus, such as a wheelchair or gurney, to be jarred or bumped as it crosses between the two flooring materials.

It is yet another object of the present invention to provide a flooring adapter device providing a transitional flooring surface between two flooring materials of different heights, and which may be installed after the two flooring materials have been installed.

It is yet another object of the present invention to provide a flooring adapter device that is easily installed using an adhesive.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings, which form a part hereof, and wherein.

DETAILED DESCRIPTION OF THE PREFERRED EMBODIMENT

Figure 1:
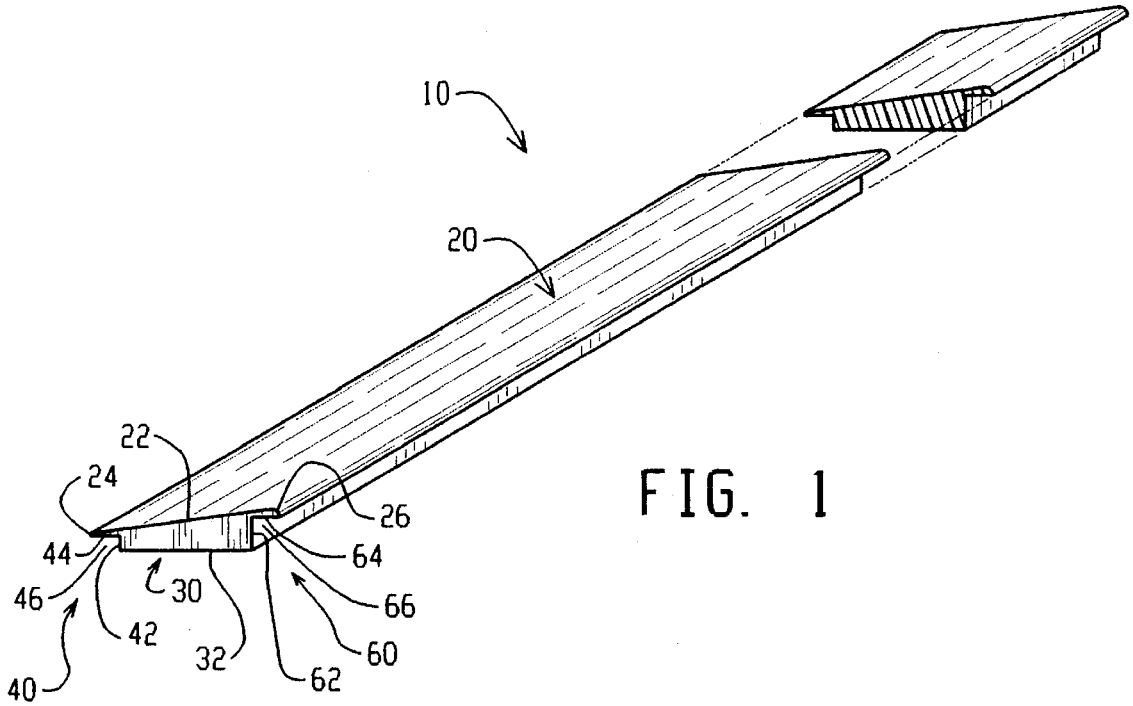
FIG. 1 is a perspective view of a sheet of the flooring adapter device according to a preferred embodiment of the present invention.

Referring now to the drawing, wherein the showing is for the purpose of illustrating a preferred embodiment of the present invention only, and not for the purpose of limiting same, FIG. 1 shows a flooring adapter device 10 according to a preferred embodiment of the present invention. In the embodiment shown, flooring adapter device 10 is an elongated, substantially flat sheet made of an extruded vinyl or rubber material. Preferably, flooring adapter device 10 is made of PVC (polyvinyl chloride).

Flooring adapter device 10 is generally comprised of an upper surface 20 and a lower surface 30. Lower surface 30 is comprised of a base portion 32, and a pair of L-shaped shoulders 40 and 60. Base portion 32 has a generally planar surface so as to engage flatly against (i.e., parallel to) the floor surface, when flooring adapter device 10 is in use.

First L-shaped shoulder 40 is comprised of a first vertical section 42 and a first horizontal section 44. First vertical section 42 is generally perpendicular to first horizontal section 44. However, it will be appreciated that since it is easier to form a radius (rather than sharp corners) using a die, a curved surface may be formed between first vertical section 42 and first horizontal section 44. A first cavity 46, dimensioned to receive a first flooring material, is defined by first vertical section 42 and first horizontal section 44. In a preferred embodiment of the present invention, first cavity 46 is dimensioned to receive a vinyl or rubber flooring material (e.g., tile) having a height of ⅛-inch. However, it should be appreciated that cavity 46 may also be dimensioned to receive other types of flooring materials, including linoleum or carpeting.

Figure 2:
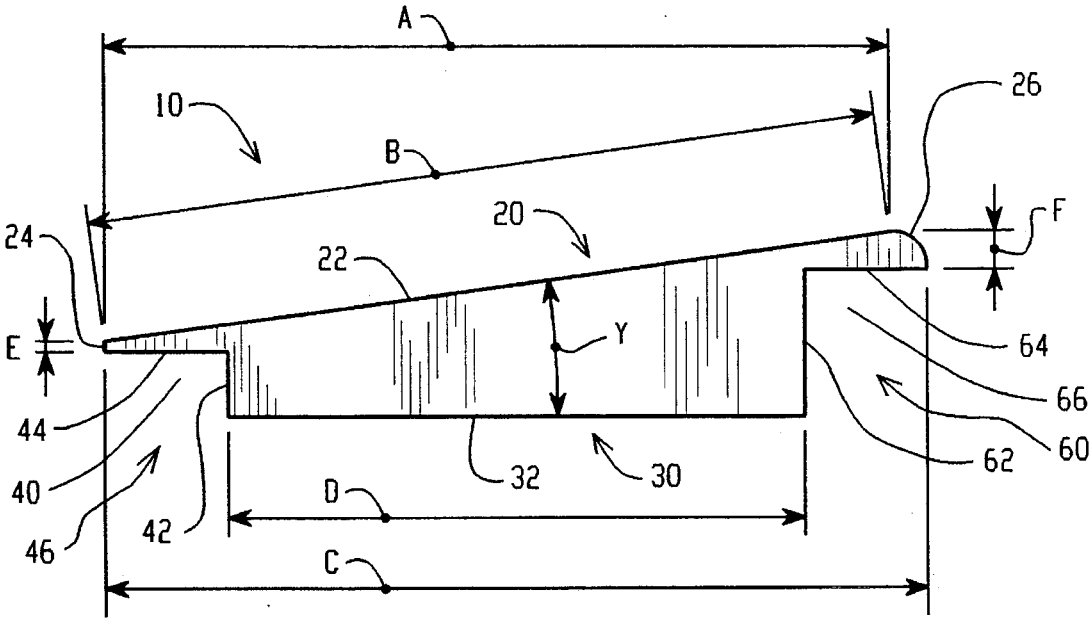
FIG. 2 is an end view of the flooring adapter device shown in FIG. 1.

Second L-shaped shoulder 60 is comprised of a second vertical section 62 and a second horizontal section 64. Second vertical section 62 is generally perpendicular to first horizontal section 64. As with the case of first vertical section 42 and first horizontal section 44, a curved surface may be formed between second vertical section 62 and second horizontal section 64 (as shown in FIG. 2), since it is easier to use a die to form a radius than sharp corners. Second vertical section 62 and second horizontal section 64 define a second cavity 66, which is dimensioned to receive a second flooring material having a second height. In a preferred embodiment, second cavity 66 is dimensioned to receive carpeting having a height of ¼-inch. However, it will be appreciated that cavity 66 may also be dimensioned to receive other types of flooring materials, including tile and linoleum.

Upper surface 20 is comprised of a central portion 22, first end portion 24 and second end portion 26. Central portion 22 has a generally flat planar surface, which is sloped relative to base portion 32. In this respect, central portion 22 is at an angle Y of approximately 30°–5° relative to base portion 32 (see FIG. 2). In a preferred embodiment of the present invention, central portion 22 is sloped upward from first end portion 24 towards second end portion 26.

First end portion 24 has a generally vertical surface extending between central portion 22 and first horizontal section 44 of first L-shaped shoulder 40. Second end portion 26 has a convexly rounded surface extending between central portion 22 and second horizontal section 64 of second L-shaped shoulder 60. The surface of second end portion 26 curves downward from central portion 22 towards second horizontal section 64.

The length of flooring adapter device 10 may vary. In this regard, flooring adapter device 10 may be provided in sheet sections of varying length, or, since extruded vinyl and rubber are somewhat flexible, in very long lengths in a roll. Preferably, flooring adapter device 10 is provided in 6-feet or 12-feet sheet sections. These lengths are most suitable for installation in hallways and doorways where transitions between carpet and tile are most common. It will be appreciated that the sheet sections may be cut to the appropriate lengths required in a particular application.

The preferred dimensions of flooring adapter device 10 will now be described with reference to FIG. 2. It will be appreciated that flooring adapter device 10, as shown in FIG. 2, is best suited as a transition between carpeting and vinyl or rubber tile. With respect to lower surface 30, base portion 32 has a preferred width dimension D of approximately 1.75 inches. First vertical section 42 has a preferred height dimension of approximately 0.125 inches, while second vertical section 62 has a preferred height dimension of 0.375 inches. First horizontal section 44 and second horizontal section 64 each have a preferred width dimension of approximately 0.375 inches. With respect to upper surface 20, first end portion 24 has a preferred height dimension E of approximately 0.032 inches. Second end portion 26 has a preferred vertical height dimension F of 0.125 inches (as measured from second horizontal section 64 to central portion 22). Central portion 22 has a width dimension A of approximately 2.375 inches, and a width dimension B of approximately 2.375 inches. The width dimension C of upper surface 20 is approximately 2.5 inches. Given the foregoing preferred dimensions, central portion 22 vertically rises approximately 0.343 inches from first end portion 24 to second end portion 26. The ratio of width dimension D of base portion 32 to width dimension C of upper surface 20 is approximately 0.7.

The flooring adapter device 10 described above is utilized in the following manner. In a preferred method of installation, the two flooring materials (e.g., carpeting and vinyl or rubber tile) are applied to the appropriate floor surface. In the case of carpeting, carpet padding may also be placed under the carpeting. Next, a section of flooring adapter device 10 of appropriate length is selected, or alternatively cut to size. Flooring adapter device 10 is then secured to the floor surface, between the two flooring materials, preferably with the use of an adhesive (e.g., liquid adhesive for vinyl or rubber flooring products or double-sided adhesive tape) or other similar means. The top of the first flooring material (e.g., vinyl or rubber tile) will be adjacent to first horizontal section 44, while the side edge of the first flooring material will be adjacent to first vertical section 42. Similarly, the top of the second flooring material (e.g., carpeting) will be adjacent to second horizontal section 64, while the side edge of the second flooring material will be adjacent to second vertical section 62. It will be appreciated that both first horizontal section 44 and second horizontal section 64 extend over the top of the respective flooring materials. When installed, base portion 32 of flooring adapter device 10 will be substantially parallel with the floor surface, while central portion 22 will be transverse to the floor surface, thus providing a gradual, sloping surface between the two flooring materials of differing heights. Alternatively, flooring adapter device 10 can be secured to the floor surface before one or both of the flooring materials is applied to the respective floor surface.

It will be appreciated that the preferred embodiment of flooring adapter device 10, as illustrated in FIGS. 1 and 2, is most suitable for use with ⅛-inch vinyl or rubber tile and ¼-inch carpet. However, it is contemplated that flooring adapter device 10 may be modified to accommodate flooring materials having varying dimensions. In this respect, the dimensions of cavities 46 and 66, the width of base portion 32 and upper surface 20, and the slope (i.e., angle Y) of central portion 22, may vary to accommodate flooring materials of varying heights.

The foregoing description is a specific embodiment of the present invention. It should be appreciated that this embodiment is described for purposes of illustration only, and that numerous alternations and modifications may be practiced by those skilled in the art without departing from the spirit and scope of the invention. It is intended that all such modifications and alterations be included insofar as they come within the scope of the invention as claimed or the equivalents thereof.

What is claimed is:

1. A flooring adapter device providing a transitional flooring surface between two flooring materials of different heights, said flooring adapter device comprising:

an elongated substantially flat member having:

a lower surface comprising:

a generally planar base portion adapted to be affixed to a floor surface and having a first width, and first and second generally L-shaped shoulders formed at opposite ends of said base portion, said L-shaped shoulders respectively defining first and second flooring material receiving cavities; and an upper surface comprising:

a central portion sloped relative to said base portion and having a second width, and first and second end portions formed at opposite ends of said central portion, said end portions connecting said upper surface to said shoulders, wherein said first width is less than said second width.

2. A flooring adapter device according to claim 1, wherein said central portion is at an angle of approximately 3°–5° relative to said base portion.

3. A flooring adapter device according to claim 1, wherein the ratio of said first width to said second width is approximately 0.7.

4. A flooring adapter device according to claim 1, wherein said first width is 1.75 inches and said second width is 2.5 inches.

5. A flooring adapter device according to claim 1, wherein said first L-shaped shoulder is comprised of a first generally planar vertical section and a first horizontal section, and said second L-shaped shoulder is comprised of a generally planar second vertical section and a second horizontal section.

6. A flooring adapter device according to claim 5, wherein said first vertical section has a height greater than said second vertical section.

7. A flooring adapter device according to claim 6, wherein said first vertical section has a height of approximately 0.125 inches and said second vertical section has a height of approximately 0.375 inches.

8. A flooring adapter device according to claim 5, wherein said first and second horizontal sections have a width of approximately equal dimension.

9. A flooring adapter device according to claim 8, wherein said width is 0.375 inches.

10. A flooring adapter device according to claim 5, wherein a curved surface is formed at the intersection of the vertical section and the horizontal section of said L-shaped shoulders, said curved surface having a center of curvature located in the material receiving cavity.

11. An adapter device according to claim 1, wherein said first flooring material receiving cavity is dimensioned to receive flooring material having a height of approximately ⅛-inch.

12. An adapter device according to claim 1, wherein said second flooring material receiving cavity is dimensioned to receive flooring material having a height of approximately ¼-inch.

13. An adapter device according to claim 1, wherein said device is made from polyvinyl chloride.

14. An adapter device according to claim 1, wherein at least one of said end portions is convexly curved.

15. An adapter device according to claim 1, wherein said central portion has a generally planar surface.

16. An adapter device providing a transitional flooring surface between two flooring materials of different heights, said flooring adapter device comprising:

an elongated substantially flat member having:

a lower surface comprising:

a generally planar base portion adapted to be affixed to a floor surface and having a first width, and first and second generally L-shaped shoulders formed at opposite ends of said base portion, said L-shaped shoulders respectively defining first and second flooring material receiving cavities; and an upper surface comprising:

a central portion sloped relative to said base portion and having a second width, and first and second end portions formed at opposite ends of said central portion, said end portions connecting said upper surface shoulders, wherein said base portion has first and second ends, and said central portion has first and second ends, the first and second ends of said central portion respectively extending beyond the first and second ends of said base portion.

* * * * *